US005344381A

United States Patent [19]

Cabrera y Lopez Caram

[11] Patent Number: 5,344,381

[45] Date of Patent: Sep. 6, 1994

[54] EQUIPMENT FOR THE ELIMINATION OF LIGHT PARTICLES, INKS AND AIR FROM A FIBER SUSPENSION FOR THE MANUFACTURE OF PAPER

[76] Inventor: Luis F. Cabrera y Lopez Caram, Meleleucas No. 173, Lomas de Cuernavaca, Cuernavaca, Morelos, Mexico

[21] Appl. No.: 911,529

[22] Filed: Jul. 10, 1992

[51] Int. Cl.[5] ..... B04B 11/06

[52] U.S. Cl. ..... 494/56; 494/60; 494/67

[58] Field of Search ..... 210/487; 494/43, 46, 494/56, 60, 63, 67, 83

[56] References Cited

U.S. PATENT DOCUMENTS

| | | | |
|---|---|---|---|
| 427,390 | 5/1890 | Beimling | 494/63 |
| 571,838 | 11/1896 | Lundstrom | 494/63 |
| 1,573,240 | 2/1926 | Grauss | 210/487 |
| 1,975,319 | 10/1934 | Grauss | 494/60 |
| 1,981,924 | 11/1934 | Reese | 494/63 |
| 1,983,701 | 12/1934 | Lewis | 494/43 |
| 2,217,062 | 10/1940 | Lewis | 494/43 |
| 2,281,797 | 5/1942 | Potter | 494/83 |
| 2,310,814 | 2/1943 | Stout | 494/46 |
| 2,327,613 | 8/1943 | Terhune | 494/43 |
| 3,022,937 | 2/1962 | Deya | 494/60 |
| 3,560,125 | 2/1971 | Trump | 494/60 |
| 3,623,657 | 11/1971 | Trump | 494/60 |
| 3,785,549 | 1/1974 | Latham | 494/43 |
| 3,963,175 | 6/1976 | Doubman | 494/43 |
| 4,412,831 | 11/1983 | Avery | 494/46 |

FOREIGN PATENT DOCUMENTS

| | | | |
|---|---|---|---|
| 847278 | 8/1952 | Fed. Rep. of Germany | 494/56 |
| 549695 | 2/1923 | France | 494/67 |
| 503317 | 1/1957 | Italy | 494/60 |

*Primary Examiner*—Timothy F. Simone
*Assistant Examiner*—Terrence R. Till
*Attorney, Agent, or Firm*—Ladas & Parry

[57] ABSTRACT

The equipment of the present invention serves to eliminate light particles, inks and air from a fibrous suspension, and consists of a vertical separating cup which spins at high speed. Feeding of the fibrous suspension and light contaminants takes place through the upper vertical portion, or through the lower vertical portion; the equipment comprises a stabilizer which serves to control the inner turbulence of the suspension, in order for light contaminants to be concentrated at the center.

9 Claims, 4 Drawing Sheets

EQUIPMENT FOR THE ELIMINATION OF LIGHT PARTICLES, INKS AND AIR FROM A FIBER SUSPENSION FOR THE MANUFACTURE OF PAPER

BACKGROUND OF THE INVENTION

At the present time several types of equipment exist for eliminating light fibrous particles in the manufacture of paper, amongst which we can mention the following:

Cyclonic cleaners, which eliminate heavy particles and light particles at the same time. This type of equipment is commonly known in the market as a tri-cleaner (light and heavy cleaner), and is built basically in the following manner:

In the upper part it has the form of a cylindrical body, and in the lower part, that of a lengthened conical body. Feeding is made tangentially through the upper part and by means of a pump; the liquid, upon separation, turns in the cleaner and heavy particles travel towards the lower part and are eliminated through a small hole. Light bodies are maintained in the inner part of the vortex and eliminated through a small extractor tube which sends these contaminants towards the upper or lower external part indiscriminately, according to the characteristic design of this equipment. The clean or partially clean fibers are extracted by the upper part and sent for processing.

Is is difficult for this type of cleaner to eliminate the air and inks trapped in the fibers.

Inverse cleaners—These cleaners are commonly known in the market as reverse cleaners. This equipment is built in an elongated conical form. Feeding is made through the conical part with the largest diameter, and acceleration of the particles, originated by hydraulic force, forces the fibers and heavier elements to circulate through the periphery and to be extracted by the lower part of the cone, that is, by the smallest part of the cone. Light bodies are extracted from the internal part of the vortex through a small hole connected to a tube, and are sent outside either through the upper or lower part of the light particles cleaner.

This type of cleaner hardly eliminates the air and inks trapped in the fibers.

Horizontal rotation equipment (Glyroclean)—The third item or type of equipment existing in the market for separating light particles consists of horizontal rotation equipment which maintains the fibrous suspension in its lower part.

When this equipment rotates, heavy particles are carried to the periphery, while light particles remain in the central part of the equipment. Extraction takes place through one of the ends of the equipment.

The differences existing between the equipment of the present invention and that presently on the market are the following:

None of the tri-cleaners or reverse cleaners achieve as high an acceleration of particles as the equipment of the invention; moreover, cleaning efficiency is fairly low.

The main difference as compared with gyroclean is that gyroclean rotates horizontally and all the liquid travels through its lower part in such a way that those accepted must exit through the central side part of the drum. This leads to heavy contaminants being retained in the inner part of the drum due to the high acceleration to which they are submitted, leading to extreme vibrations which, at a given moment, could damage the equipment or oblige a stop for cleaning.

The equipment of the present invention does not do this, since the cup makes the particles being extracted travel upwards, after which they travel downwards outside the cup and are eliminated in a section which separates the heavy particles.

Both drawings show the motor for moving the rotation element, the transmission of potency pulleys, the bearings which support the shaft, the entries of pulp to be cleaned, the light contaminants exits, the heavy contaminants exit and the clean pulp exit.

Parts are listed in the following manner in both drawings; when the part is the same in both drawings, the number coincides. Where different alternatives are shown the number changes and this is mentioned.

Figure 1:
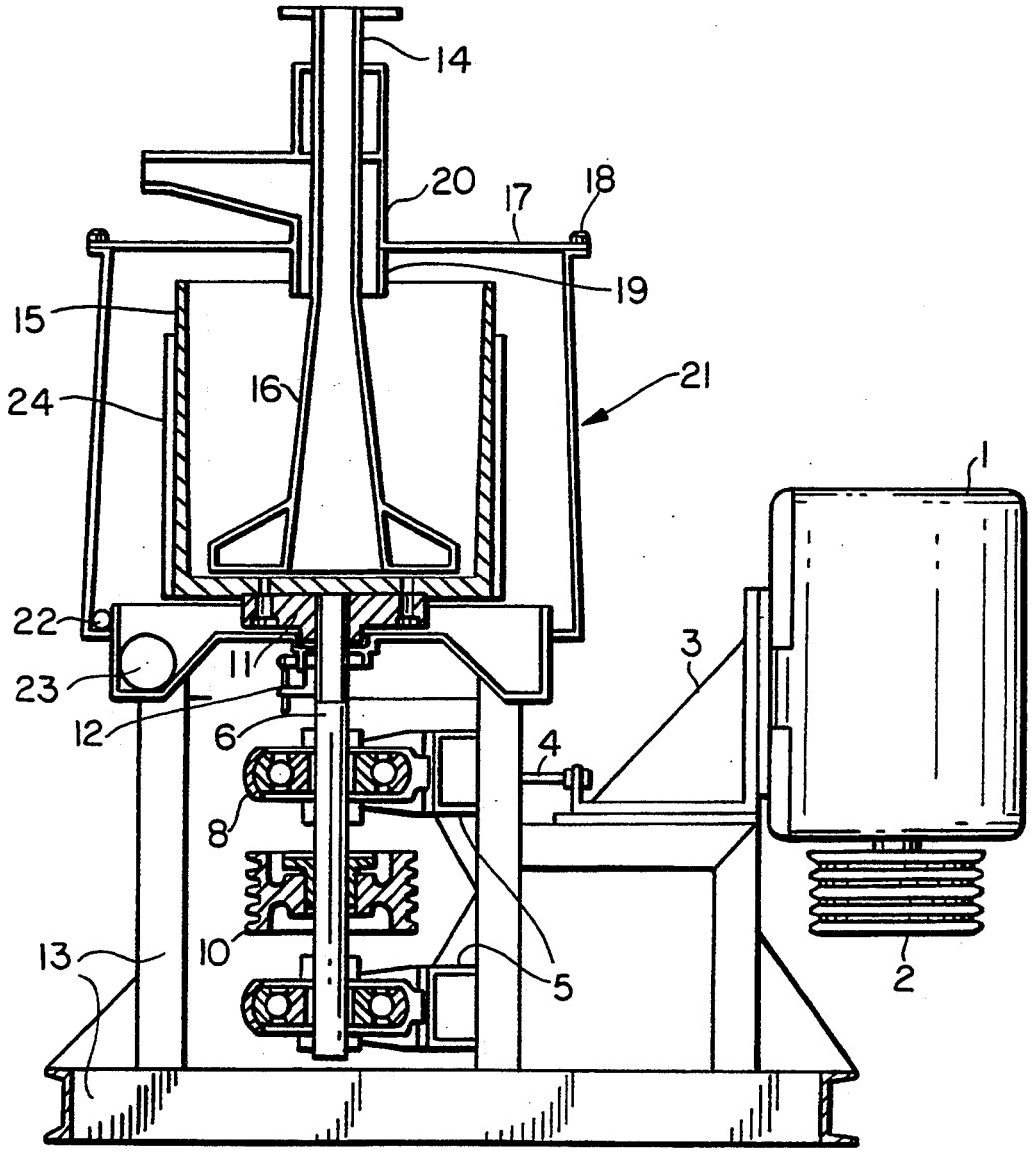
FIG. 1 shows the equipment of the invention, in which feeding takes place through the upper part.
Figure 2:
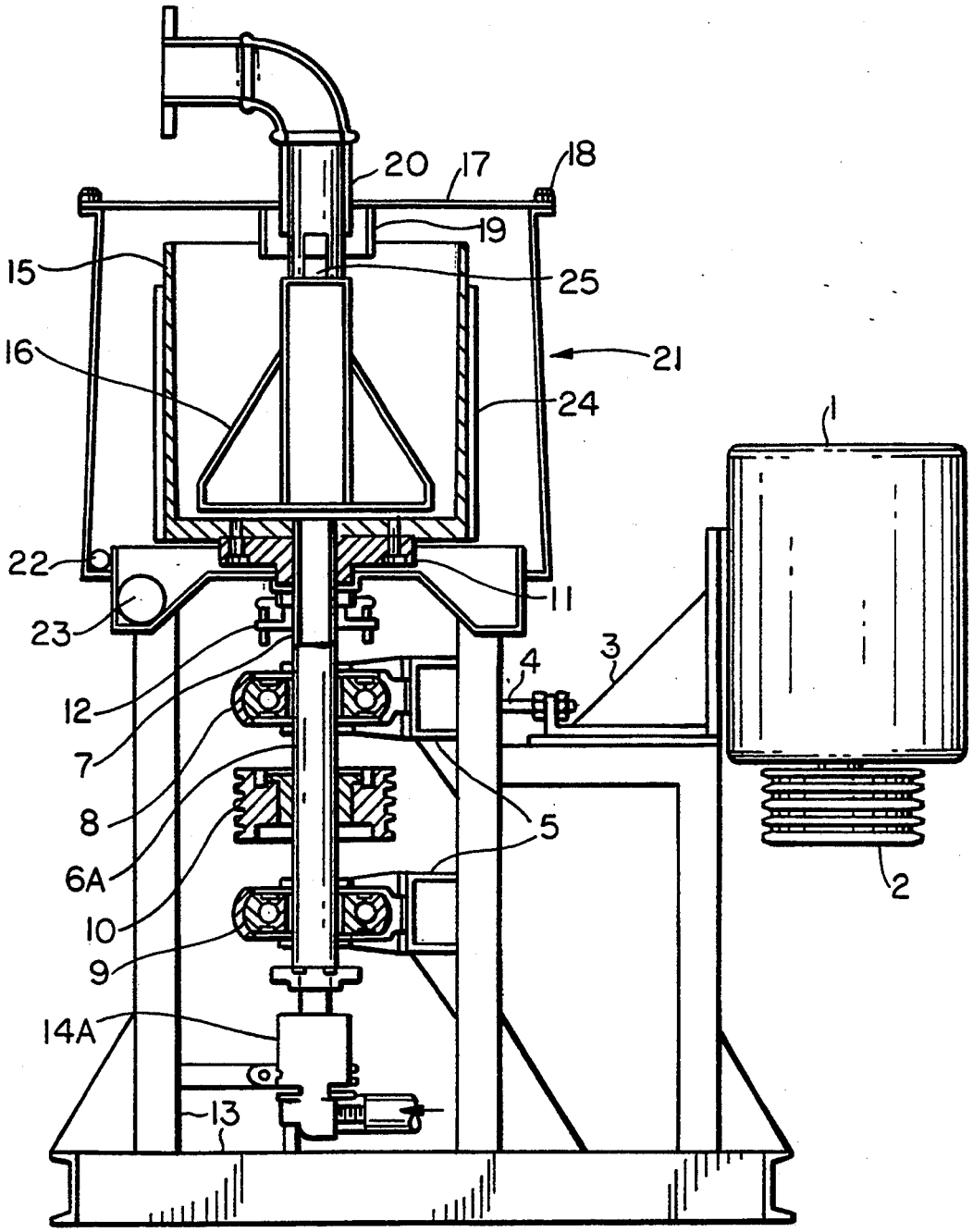
FIG. 2 represents the equipment of the invention in another form, where feeding is carried out through the lower part. In accordance with the drawings, one of these presents feeding through the upper part and the other shows, as an alternative, feeding through the lower part by means of the drive shaft of the cup.
Figure 3:
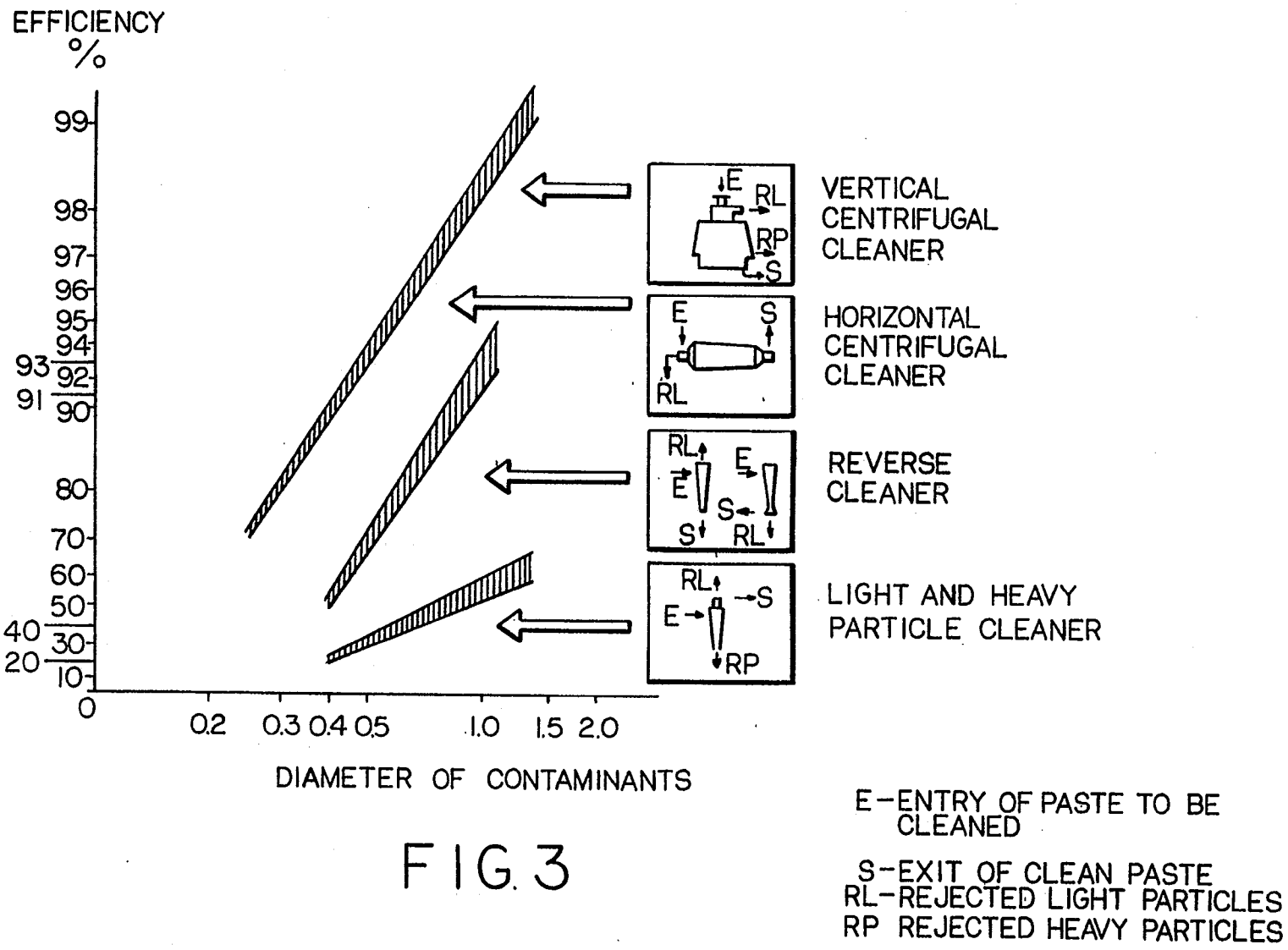

FIG. 3 is a comparison diagram of the separation of light contaminants for different types of cleaners.

Figure 4:
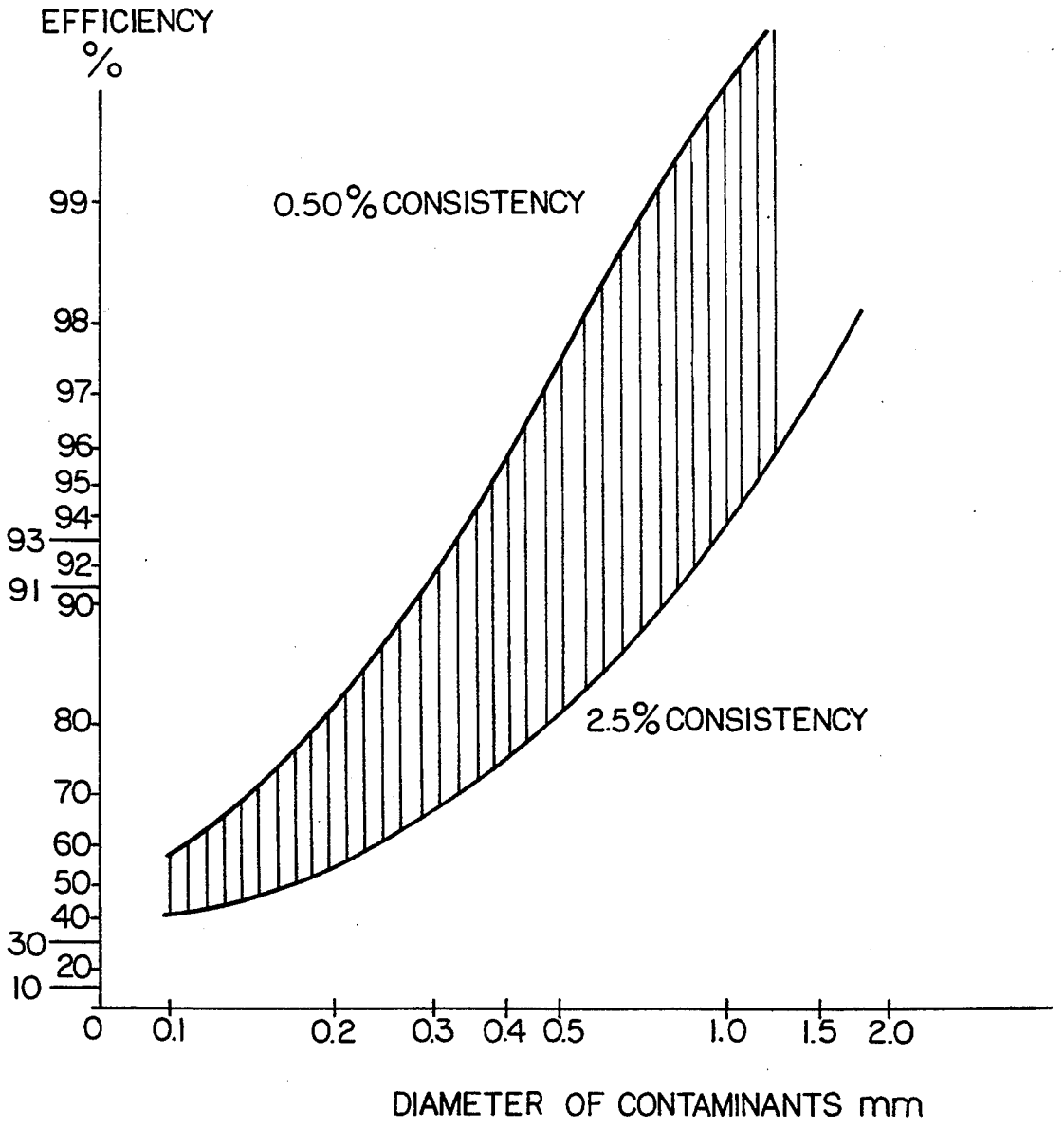

FIG. 4 is a diagram showing the light contaminants separation efficiency range with variation of consistency.

DETAILED DESCRIPTION OF THE INVENTION

The machine moves by means of an electric motor (1) which is mounted on a support (3); bands are tightened by means of a device (4) which prevents the bands from slipping on the pulleys. The motor has a driving pulley (2) which transmits the movement to the moving pulley (10); this pulley is mounted on a shaft (6), which moves the cup.

In the case of a second alternative, the liquid to be cleaned is conducted through the shaft (6A); the shaft is mounted on two bearings (8 and 9). The design of these bearings should be such as to permit axial and radial loads. The bearings are mounted on some supports (5) which allow them to be fastened in order to avoid vibrations. In both cases the shaft ends in its upper part in a support (11), which allows it to be fastened to the rotating cup (15). The shaft in its outer part is cylindrical and has four vanes (24) to accelerate the pulp outwards.

The feeding of fibers to be cleaned enters by the upper part through a tube (14), which descends and then penetrates through the inner part of the stabilizer (16) until it reaches the inner lower part of the cup (15). In the case of the second alternative, the pulp penetrates by the lower part through a rotating joint (14A), passing vertically upwards through the hollow shaft (6A) until it reaches the lower part of the stabilizer (16) and lower part of the cup (15). The stabilizer (16) is coupled to the upper cover (17) through the light contaminants collector (19). The inner part of the stabilizer (16) is conterminous with a tube (14) through which the feeding of fibers to be cleaned enters the cup. The stabilizer (16) is not connected to the cup and accordingly it does not rotate with the cup. Between the stabilizer (16) and the inner lower part of the cup (15) there is a space which allows the liquid to cleaned to flow towards the inner vertical surface of the rotatory cup (15).

The cup is spinning at high speed to lead to acceleration of the particles. Once the entire fibrous suspension, including contaminants, is in the lower inside part of the cup, acceleration takes place due to centrifugal force until the vertical walls of the cup are reached.

If feeding is through the upper vertical part, this takes place through a tube leading to the bottom of the cup. Due to the high speed, the cup propels the fluid towards the lower periphery of the cup itself, obliging heavy particles to remain within the inner periphery of the cup, and light contaminants to gravitate towards the center. If feeding is through the lower part, it takes place by means of the cup propelling shaft, with suspension reaching the lower internal part of the cup and being controlled by the stabilizer, which keeps it in contact with the cup and pushes it towards the inner periphery. The cup, by rotating at high speed, maintains heavy particles in the periphery while light particles gravitate towards the center. In this same manner, the stabilizer avoids turbulence, keeping light contaminants in the center; as the fibrous suspension travels towards the upper part of the cup, light contaminants are extracted by means of a light collector placed exactly at the upper end of the stabilizer.

Heavy particles consisting of fibers and contaminants which are heavier than the fibers leave the cup, and travel on this occasion outside the cup and downwards; the contaminants which are heavier than the fibers travel downwards stuck to the body of the equipment, due to the centrifugal action achieved by rotation of the cup. Heavy contaminants are extracted by a lateral tube and the fibers travel a little farther down and are extracted by another tube. Extraction can be on the same side, or be located at different angles in accordance with the needs required.

One of the most important characteristics of the cup is that it is machined in such a way that the lower internal diameter of the cup is less than the upper internal diameter of the cup. This means that the cup has a slight cone-shaping inside so that, in conjunction with the acceleration of the particles originated by cup rotation and the ascending flow, a resultant is generated which allows the heavy particles to flow towards the upper part of the cup. The gravitational force originated by the rotation of the cup leads to the heavy particles being maintained as close as possible to the internal wall of the cup, and light contaminants being placed towards the center of the rotation vortex. The stabilizer (16) allows a very smooth transition of particles, also, avoiding turbulence in the center of the cup. Light contaminants are placed in the center and extracted through a light contaminants collector (19).

In the case of the second alternative, light contaminants penetrate by an extraction opening (25), and are extracted by a tube (20) towards the outside. The same happens in the case of the first embodiment, light contaminants are extracted through the tube (20), and are then conducted towards an outside light contaminants collector.

It is important to mention that the light contaminants collector is joined to the upper cover (17) of the purifier (21), which is fixed to the body of the purifier (21) by means of some screws (18).

When the light contaminants have been separated, the fibrous suspension emerges from the cup and flows on the outside of the cup downwards. The cup (15) has some vanes (24) on the outside which force acceleration of the heavy particles. In this case, the body of the purifier (21) is conical in shape in order that, in conjunction with acceleration of the heavy particles achieved by the cup rotation effect, a resulting force is generated which allows the heavy particles to travel downwards for extraction through the opening (22). This opening allows all heavy particles to be carried to an external collection system. The fibrous suspension continues to travel downwards and is extracted by a tube (23) which allows it to be conveyed outside.

The vanes can be eliminated in order to decrease the power consumption of the equipment of the present invention, resulting in lowering efficiency of heavy particle separation without lessening the efficiency of light contaminants elimination. In this case the vanes could be replaced by metallic rings placed on the outer part of the cup.

It is placed on record that, with regard to this date, the best method known by the applicant for putting said invention into practice is the conventional method for manufacture of the objects to which it refers.

Having described the invention as above, the contents of the following claims is hereby claimed in ownership:

I claim:

1. An apparatus for purification of a fibrous suspension containing fibers of desired weight, first contaminants which are lighter than the fibers, and second contaminants which are heavier than the fibers, said apparatus comprising:

a) a purifier body having an inner wall;

b) a rotation cup in which the suspension is rotated, said rotation cup comprising an inner surface and an outer surface and being situated within the purifier body such that the inner wall of the purifier body and the outer surface of the rotation cup define a space wherein suspension overflowing the cup is received, said rotation cup further comprising an inner top portion and an inner bottom portion each having a diameter, the inner surface of the rotation cup being conical in shape with the inner surface diverging from said inner bottom portion to said inner top portion such that the diameter of the inner top portion is greater than the diameter of the inner bottom portion;

c) feeding means for feeding the suspension into the inner bottom portion of the rotation cup;

d) motor means for rotating the rotation cup along a vertical axis of rotation such that suspension in the cup can be made to flow in response to centrifugal force;

e) stabilizer means for controlling the flow of suspension within the rotation cup, said motor means being capable of rotating said rotation cup at sufficient speed such that, upon rotation of the cup by said motor means, the suspension flow controlled by the stabilizer means, is caused to flow upward toward the inner top portion of the cup with the fibers and second contaminants concentrated toward the inner surface and with the first contaminants concentrated in an area around the vertical axis of rotation;

f) first collector means for collecting suspension that flows to the inner top portion of the cup and is concentrated in the area around the vertical axis such that the first contaminants are collected by the first collector means whereby only suspension substantially purified of said first contaminants overflows the cup and is received into the space between the inner wall of the purifier body and the outer surface of the cup;

g) accelerator means attached to the outer surface of the rotation cup and rotating with said cup for causing the overflowing suspension to separate into a first portion containing said second contaminants and a second portion containing said fibers, said accelerator means accelerating the first portion toward said inner wall;

h) second collector means situated proximal to said inner wall for collecting said first portion; and i) third collector means for collecting said second portion containing the fibers.

2. An apparatus as claimed in claim 1 wherein said purifier body has an upper part and a lower part each having a diameter, said inner wall diverging from said upper part to said lower part such that the diameter of said lower part is greater than the diameter of said upper part, said second collector means comprising a pipe situated in said space along the inner wall of the purifier body in the lower part of the body, said accelerator means causing the first portion containing the second contaminants to flow along said inner wall into said pipe with the second portion containing the fibers flowing along said outer surface of the cup into a lower conduit.

3. An apparatus as claimed in claim 2 wherein the outer surface of the cup is generally cylindrical in shape.

4. An apparatus as claimed in claim 3 wherein the motor means comprises a plurality of bands mounted in pulleys, and further comprises tightening device means for tightening the bands to avoid slipping of the bands in the pulleys.

5. An apparatus as claimed in claim 3 wherein said motor means comprises a motor, a propelling pulley, a propelled pulley and a shaft, mounted on a plurality of bearings, said propelled pulley being mounted on the shaft, said motor causing said propelling pulley to transmit movement to said propelled pulley whereby to turn the shaft which in turn rotates the cup.

6. An apparatus as claimed in claim 5 wherein the motor means further comprises support means for supporting said bearings so they do not vibrate.

7. An apparatus as claimed in claim 3 wherein the accelerator means comprises a plurality of vanes.

8. An apparatus as claimed in claim 7 wherein the vanes are spaced equidistantly around the outer surface of the cup.

9. An apparatus as claimed in claim 8 wherein there are four vanes.

* * * * *